US005443292A

United States Patent [19]

Shimada et al.

[11] Patent Number: 5,443,292

[45] Date of Patent: Aug. 22, 1995

[54] POWER LID CLOSING DEVICE

[75] Inventors: Junichi Shimada; Yuichi Kato, both of Yokohama, Japan

[73] Assignee: Ohi Seisakusho Co., Ltd., Yokohama, Japan

[21] Appl. No.: 87,335

[22] Filed: Jul. 8, 1993

[30] Foreign Application Priority Data

Jul. 8, 1992 [JP] Japan ..... 4-047772 U
Jul. 8, 1992 [JP] Japan ..... 4-047773 U
Jul. 8, 1992 [JP] Japan ..... 4-047774 U

[51] Int. Cl.[6] ..... E05B 15/02

[52] U.S. Cl. ..... 292/341.16; 292/201; 292/216; 292/DIG. 43; 70/241

[58] Field of Search ..... 292/341.16, 201, 216, 292/DIG. 43, 341.18; 70/241

[56] References Cited

U.S. PATENT DOCUMENTS

| | | | |
|---|---|---|---|
| 3,835,678 | 9/1974 | Meyer et al. | 70/241 |
| 4,544,189 | 10/1985 | Fiordellisi et al. | 292/DIG. 43 X |
| 4,652,027 | 3/1987 | Quantz | 292/201 |
| 4,667,990 | 5/1987 | Quantz | 292/201 |
| 4,796,932 | 1/1989 | Tame | 292/DIG. 43 X |
| 4,869,537 | 9/1989 | Compeau et al. | 292/341.18 |
| 4,905,532 | 3/1990 | Fukumoto et al. | 292/201 X |
| 4,961,601 | 10/1990 | Lindholm et al. | 292/216 |
| 4,974,885 | 12/1990 | Yokoyama | 292/341.16 X |
| 4,976,477 | 12/1990 | Nakao | 292/201 |
| 4,976,478 | 12/1990 | Acciacca et al. | 292/341.16 X |
| 4,986,579 | 1/1991 | Ishikawa | 292/201 |
| 5,007,261 | 4/1991 | Quantz | 292/216 X |
| 5,020,838 | 6/1991 | Fukumoto | 292/DIG. 43 X |
| 5,118,146 | 6/1992 | Watanuki | 292/341.16 X |
| 5,154,460 | 10/1992 | Bartsch | 292/216 X |
| 5,238,274 | 8/1993 | Becker et al. | 292/201 |
| 5,240,296 | 8/1993 | Kobayashi | 292/201 |
| 5,295,374 | 3/1994 | Bender et al. | 292/201 X |

FOREIGN PATENT DOCUMENTS

| | | |
|---|---|---|
| 3638305 | 5/1987 | Germany . |
| 3900508 | 8/1989 | Germany . |

*Primary Examiner*—Peter M. Cuomo
*Assistant Examiner*—Suzanne L. Dino
*Attorney, Agent, or Firm*—Foley & Lardner

[57] ABSTRACT

A lock mechanism is mounted on a pivotal trunk lid. A lid drawing mechanism is mounted in a fixed member of a trunk space of a vehicle body. The lid drawing mechanism includes a motor mounting plate which is stationary, a striker base plate which is pivotally connected to the motor mounting plate and an output disc which pivots the striker base plate when rotated. The striker base plate has a striker which is engageable with the lock mechanism. A power unit is mounted to the fixed member and includes an electric motor and a speed reduction gear which are installed in a housing secured to the motor mounting plate. A rotation transmitting device is employed for transmitting rotation of the spur gear to the output disc irrespective of a certain axial displacement therebetween.

18 Claims, 20 Drawing Sheets

POWER LID CLOSING DEVICE

BACKGROUND OF THE INVENTION

1. Field of the Invention

The present invention relates in general to power lid closing devices for motor vehicles and more particularly to power lid closing devices for closing a lid, such as a trunk lid or the like, by the force of an electric power. More specifically, the present invention is concerned with power lid closing devices of a type which comprises a lid drawing mechanism mounted on a trunk structure of a vehicle body and an electric power unit coupled with the lid drawing mechanism for powering the same, wherein when a trunk lid is manually pivoted down to an almost closed position, the lid drawing mechanism catches the trunk lid and enforcedly pulls down the same to the fully closed position.

2. Description of the Prior Art

In order to clarify the task of the present invention, one conventional power lid closing device of the above-mentioned type will be described with reference to FIGS. 28 to 31, which is shown in Japanese Patent First Provisional Publication 4-302683.

As is understood from FIGS. 28 and 29, the conventional power lid closing device comprises a motor mounting plate 1 and a cover base plate 2 which face each other to define therebetween a space. As is seen from FIG. 29 a latch base plate 3 is installed in the space and has one end pivotally supported. The motor mounting plate 1 carries thereon an electric motor 4 (see FIG. 28) and a speed reduction gear 5. An output shaft 5a of the speed reduction gear 5 is projected into the space between the motor mounting plate 1 and the cover base plate 2. As is best seen from FIG. 30, the output shaft 5*a* has at a leading end thereof a connecting pin 5*b* connected thereto. As will be seen from FIG. 31, the cover base plate 2 is provided near the output shaft 5*a* of the speed reduction gear 5 with an output shaft 7 of a driving mechanism 6 by which the latch base plate 3 is pivoted. As is seen from FIG. 29, a leading end of the output shaft 7 is formed with an engaging groove 7*a* with which the connecting pin 5*b* of the output shaft 5*a* is engaged. Thus, the output shaft 5*a* and the other output shaft 7 can rotate like a unit. Because of a so-called "joint mechanism" provided by both the connecting pin 5*b* and the engaging groove 7*a*, the connection of the output shaft 5*a* to the output shaft 7 is achieved with ease. That is, even though a slight displacement is present between these two output shafts 5*a* and 7 upon assembly, operative connection is achieved therebetween. As is seen from FIG. 30, the output shaft 5*a* of the speed reduction gear 5 has a sector cam 8 secured thereto. A limit switch 9 is mounted to the motor mounting plate 1, which has a detecting arm 9*a* slidably engaged with a cam surface 8 of the sector cam 8. Thus, the angular position of the output shaft 5*a* of the speed reduction gear 5 can be detected by the limit switch 9. In accordance with information signals issued by the limit switch 9, operation of the electric motor 4 is controlled.

However, in the above-mentioned conventional power lid closing device, the joint mechanism provided by both the connecting pin 5*b* and the engaging groove 7*a* is excessively long, which causes a marked increase in thickness of the lid closing device and thus brings about a bulky construction of the same. Furthermore, in the conventional device, the joint mechanism tends to produce a noise due to its inherent construction. Furthermore, in the conventional device, the lid pulling force generated by the device is generally constant and relatively strong throughout the closing stroke for the lid. Thus, if operator's hand or hands are accidentally caught in the lid during closing movement of the lid, he or she can not pull out the hands with ease.

SUMMARY OF THE INVENTION

It is therefore an object of the present invention to provide a power lid closing device which is free of the above-mentioned drawbacks.

According to the present invention, there is provided a power lid closing device for use in a structure wherein a lid member is pivotally connected to a fixed member. The lid closing device comprises a lock mechanism mounted on the lid member; and a lid drawing mechanism mounted on the fixed member, the lid drawing mechanism including a motor mounting plate which is stationary, a striker base plate which is pivotally connected to the motor mounting plate and an output disc which pivots the striker base plate when rotated, the striker base plate having a striker engageable with the lock mechanism.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
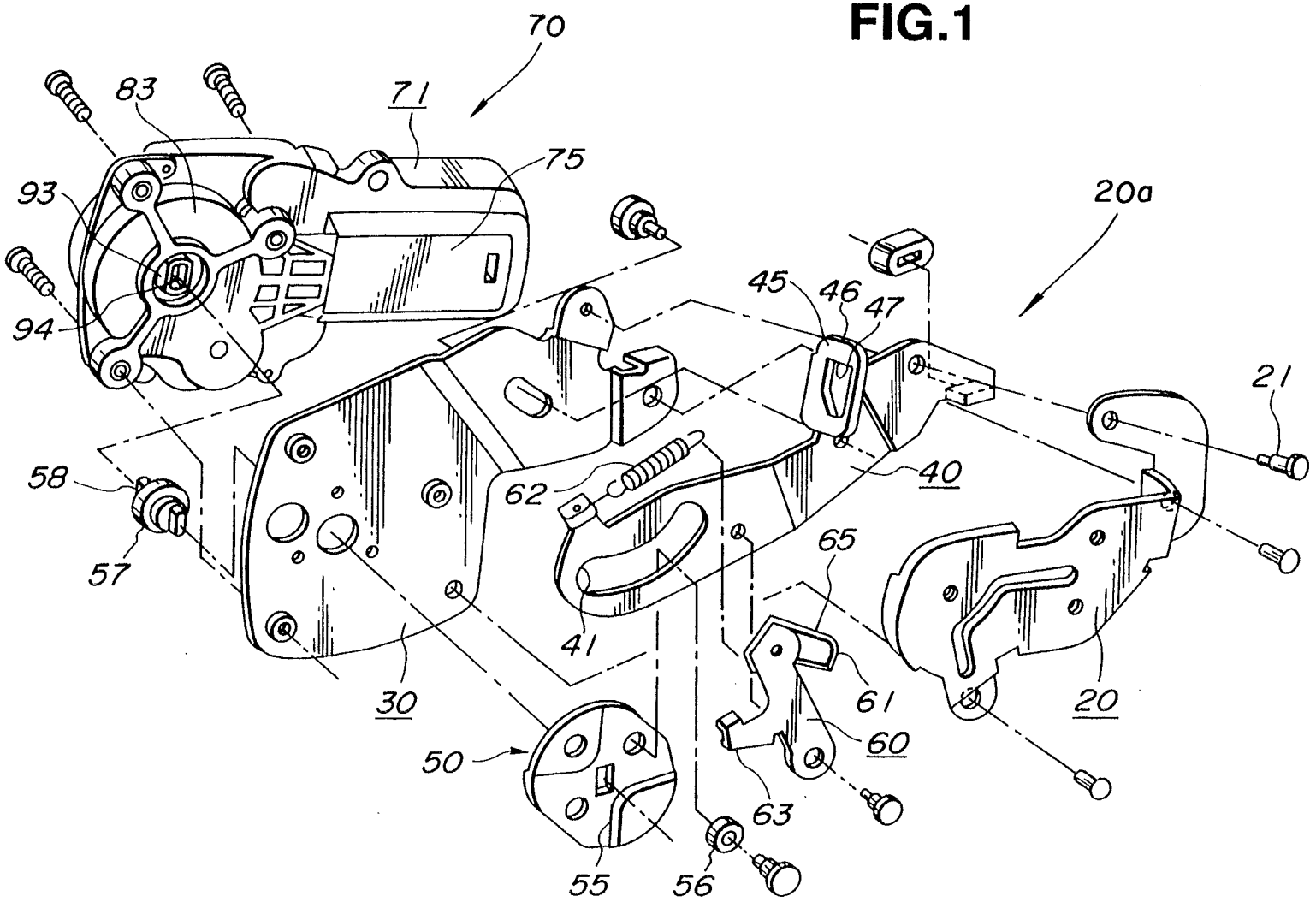
FIG. 1 is an exploded view of a power lid closing device of the present invention.

Referring to FIGS. 1 to 27 of the drawings, there is shown a power lid closing device according to the present invention.

As is seen from FIG. 2, the power lid closing device of the present invention, which will be described in detail in the following, is applied to a rear trunk construction of a passenger motor vehicle.

The rear trunk construction comprises a trunk space 11 which is defined in a rear portion of the vehicle body and a trunk lid 10 which is pivotally connected to the vehicle body to close and open the trunk space 11. Although not shown in the drawing, a conventional weather strip extends along the periphery 12 of the mouth of the trunk space 11.

Figure 2:
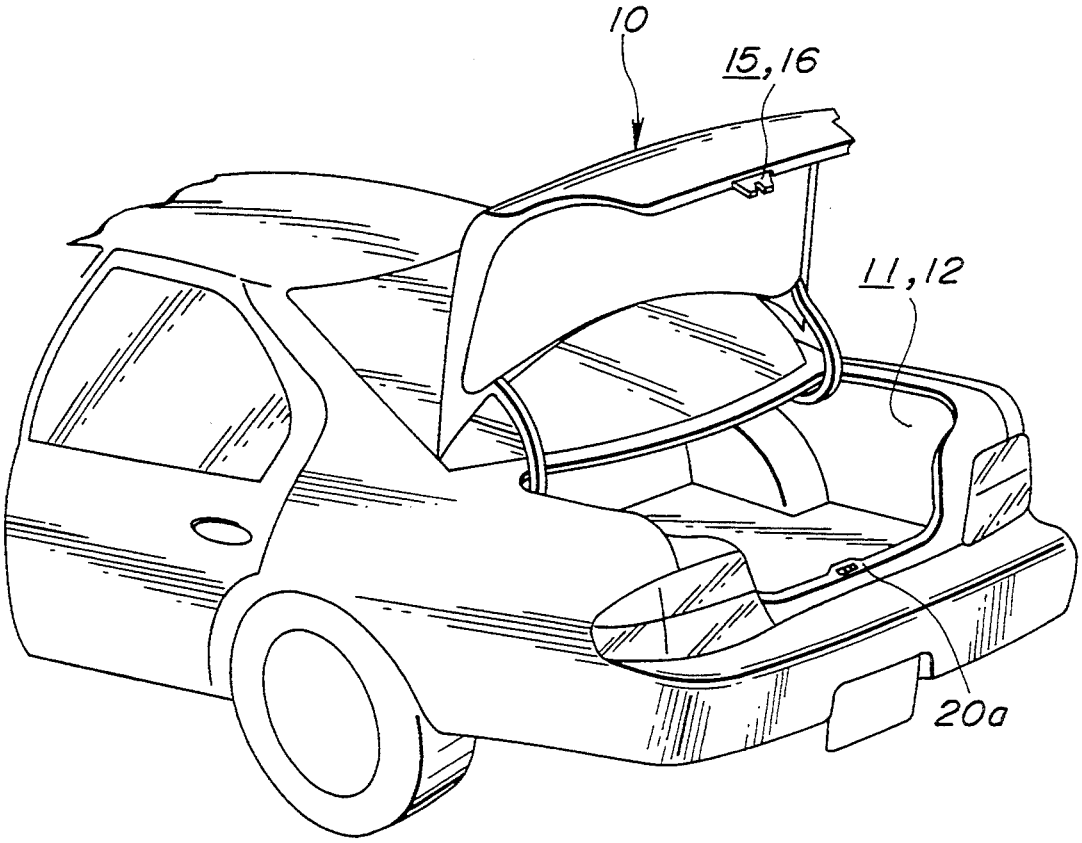
FIG. 2 is a rear view of a passenger motor vehicle to which the power lid closing device of the invention is practically applied.

As shown in FIG. 2, the trunk lid 10 has at its leading edge portion a lock mechanism 15 mounted thereto, and the vehicle body has a lid drawing mechanism 20*a* mounted thereto. As will become apparent as the description proceeds, when the trunk lid 10 is pivoted down to an almost closed position, the lock mechanism 15 catches a striker (45) of the lid drawing mechanism 20*a* and thereafter the lid drawing mechanism 20*a* draws down the trunk lid 10 into a fully closed position by electric power.

Figure 18:
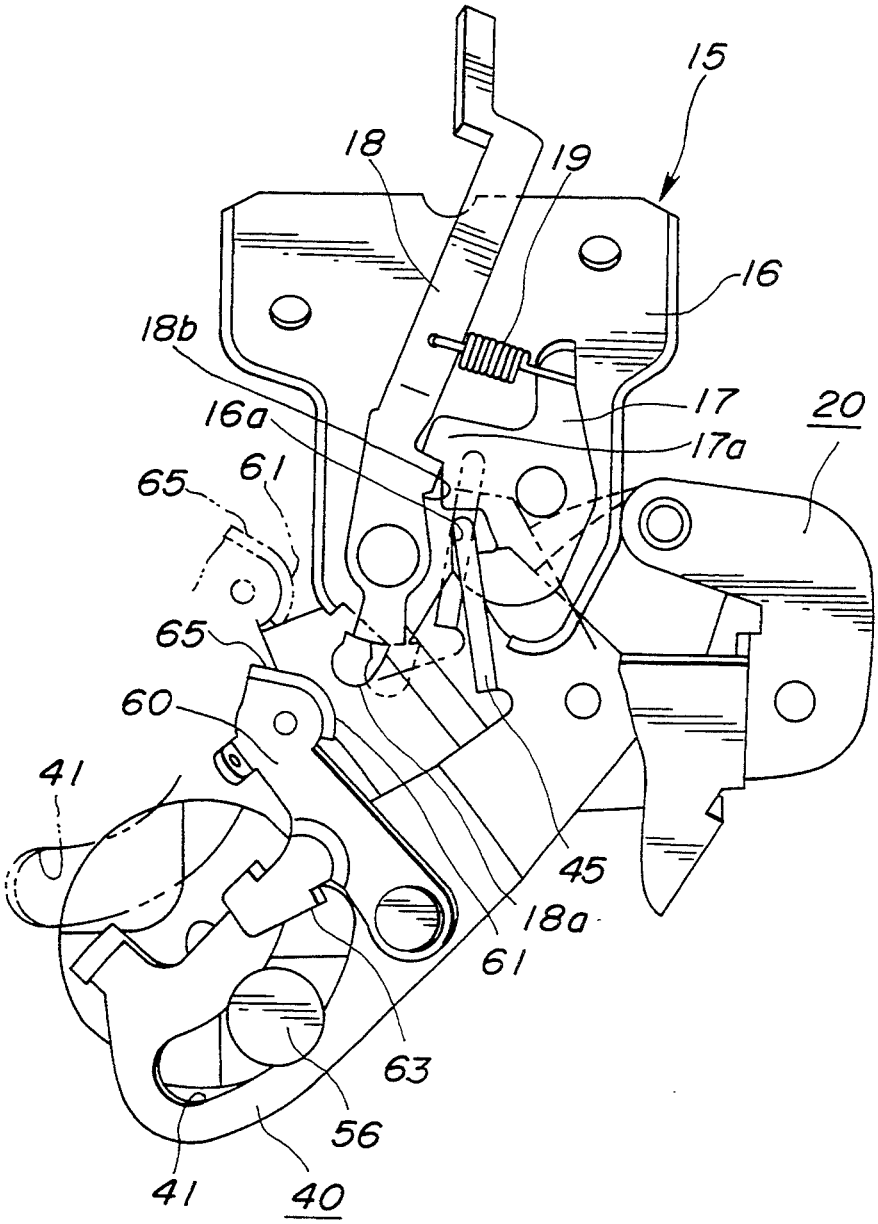
FIG. 18 is a front view of essential parts of the power lid closing device.

As is seen from FIG. 18, the lock mechanism 15 comprises a lock base plate 16 secured to the trunk lid 10. The lock base plate 16 is formed at its lower part with a generally triangular recess 16*a* into which the striker (45) of the lid drawing mechanism 20*a* is inserted upon closing of the trunk lid 10. A latch plate 17 and a locking plate 18 are pivotally connected to the lock base plate 16. A tension spring 19 extends between the latch plate 17 and the locking plate 18 to bias them in opposite directions. As will be described in detail hereinafter, the latch plate 17 can pivot to a latching position to latch the striker (45) of the lid drawing mechanism 20*a* and, the locking plate 18 can pivot between a locking position wherein the locking plate 18 is engaged with the latch plate 17 to lock the same at the latching position and an unlocking position wherein the locking plate 18 is disengaged from the latch plate 17 to permit the same to release the striker (45). The tension spring 19 biases the latch plate 17 and the locking plate 18 in the directions to achieve the engagement therebetween. The locking plate 18 has a lower end 18*a* which is rounded.

Figure 19:
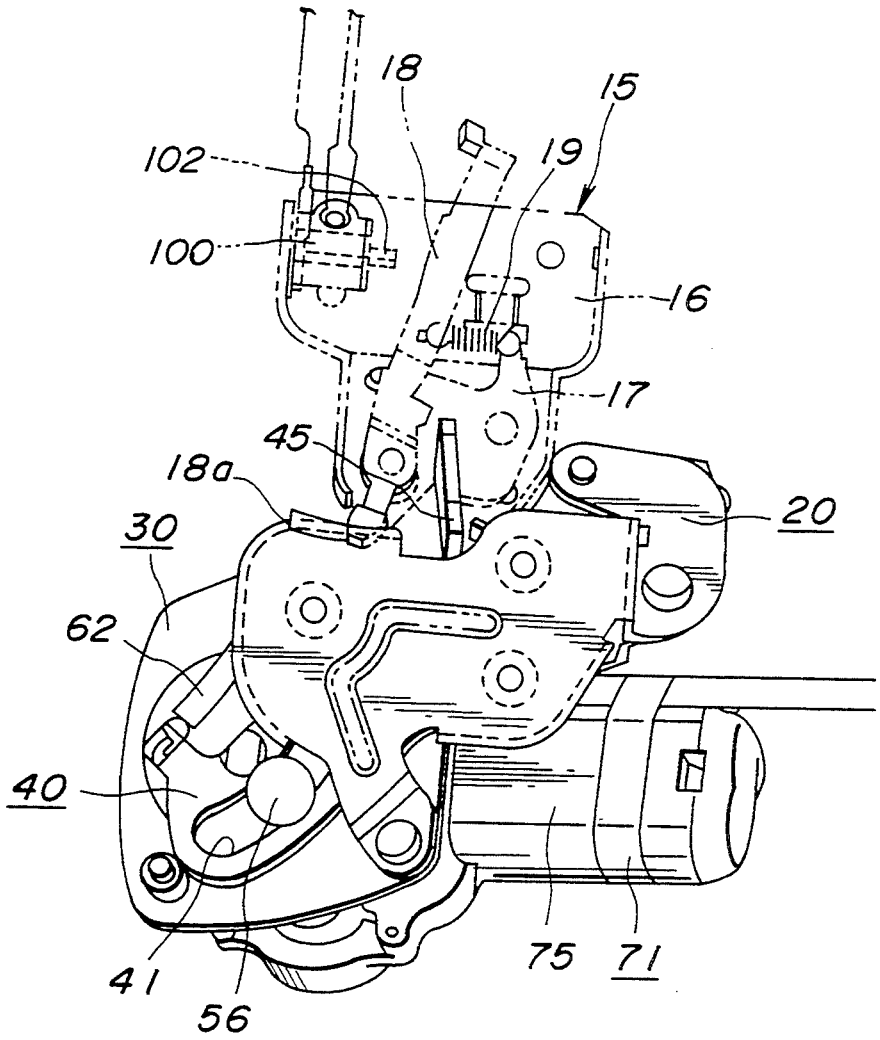
FIG. 19 is a back view of the power lid closing device.
Figure 20:
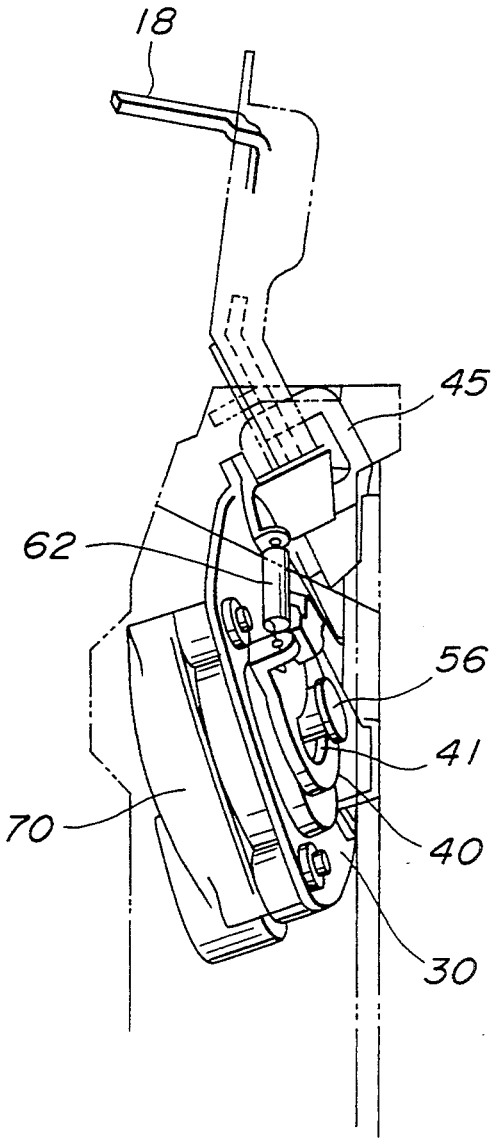
FIG. 20 is a side view of the power lid closing device.

As is understood from FIG. 19, a switch 100 is fixed to the lock base plate 16. The switch 100 has a switch knob 102 which is actuated by the locking plate 18. That is, when the switch knob 102 is pressed by the locking plate 18, the switch 100 assumes OFF condition, while, when the knob 102 is released from the locking plate 18, the switch 100 assumes ON condition.

As is seen from FIGS. 1 and 18, the lid drawing mechanism 20*a* comprises a base plate member 20 secured to an inner panel of the trunk space 11, a motor mounting plate 30 superposed over the base plate member 20 and a striker base plate 40 which is installed within a clearance defined between the base plate member 20 and the motor mounting plate 30. The base plate member 20 and the motor mounting plate 30 constitute a supporting base structure.

Figure 21:
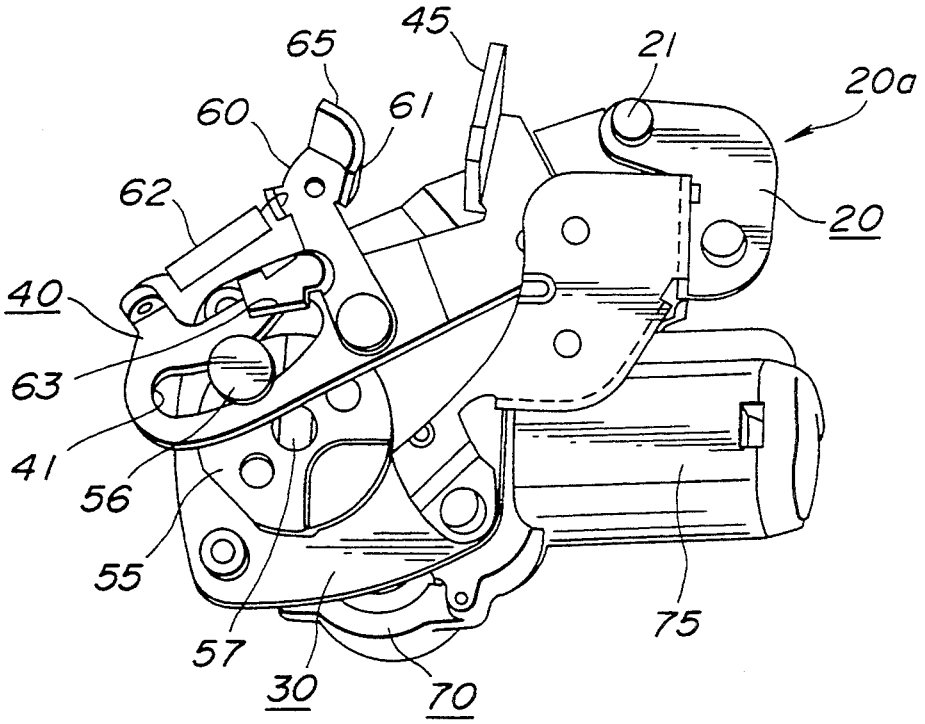
FIGS. 21 to 24 are views of essential parts of the power lid closing device, but showing different operation conditions.
Figure 23:
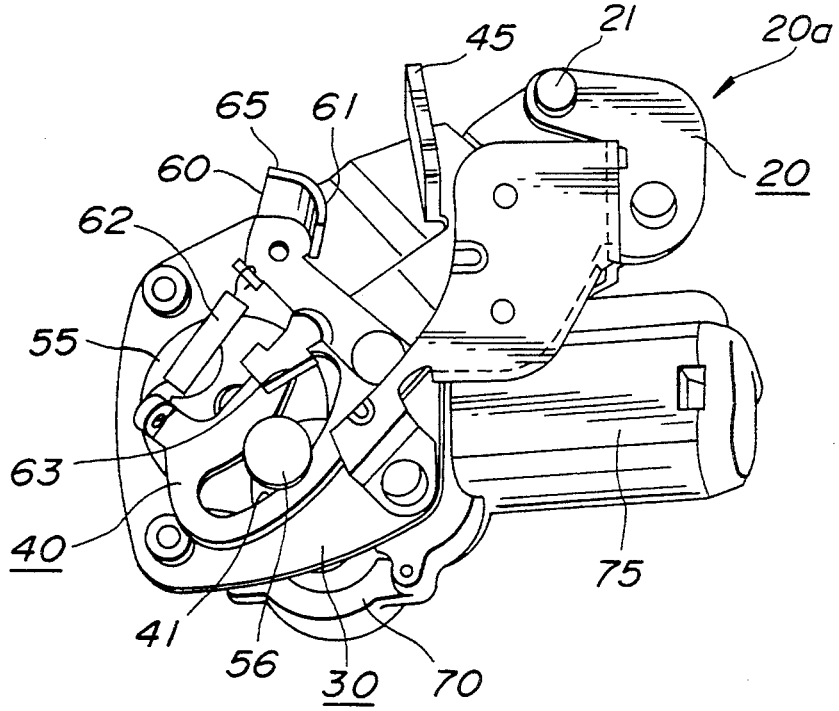

As is seen from FIG. 1, a pivot pin 21 extends between the base plate member 20 and the motor base plate 30, by which one end of the striker base plate 40 is pivotally held. Thus, the striker base plate 40 can pivot about the pivot pin 21 between a drawing start position as shown in FIG. 21 wherein the free end of the plate 40 is raised and a drawing stop position as shown in FIG. 23 wherein the free end of the plate 40 is lowered. The striker base plate 40 is integrally formed with the above-mentioned striker 45. As shown, the striker 45 comprises a bent part 46 of the plate 40, which is formed with an engaging opening 47.

As is best shown in FIG. 1, a drive mechanism 50 is mounted to the other end portion of the base plate member 20, which functions to draw or pull down the above-mentioned latch plate 17 of the lock mechanism 15 through the striker 45. The drive mechanism 50 comprises an arcuate cam slot 41 which is formed in the free end portion of the striker base plate 40 and an output disc 55 which is rotatably connected to one end of the motor mounting plate 30. The output disc 55 has at one end a cam follower 56 which is slidably engaged with the cam slot 40.

As will be described hereinafter, when, due to the function of a power unit, the output disc 55 is rotated in one direction, the cam follower 56 slidably moves in the arcuate cam slot 41 pivoting the striker base plate 40 about the pivot pin 21 between the drawing start position (FIG. 21) and the drawing stop position (FIG. 23).

The arcuate cam slot 41 is so shaped that upon rotation of the output disc 55 at a constant speed causing the striker base plate 40 to pivot downward from the drawing start position toward the drawing stop position, the pivoting speed of the striker base plate 40 changes. That is, at an initial stage of the lid drawing movement, the pivoting speed of the striker base plate 40 is relatively high and thus the lid pulling force is relatively small, and at a final stage of the lid drawing movement, the pivoting speed of the striker base plate 40 is relatively low and thus the lid pulling force is relatively large. In order to achieve such movement, the arcuate cam slot 41 has a radius of curvature which is slightly larger than that described by the cam follower 56 on the output disc 55.

As is seen from FIGS. 1 and 18, an open lever 60 is pivotally connected at its lower end to the striker base plate 40. The open lever 60 functions to abut against the lower rounded end 18*a* of the locking plate 18 of the locking mechanism 20*a* to pivot the locking plate 18 from the locking position to the unlocking position.

As is seen from FIG. 1, the open lever 60 is formed at its upper end with an output portion 61 which is engageable with the lower end 18*a* of the locking plate 18. A spring 62 extends between the striker base plate 40 and the open lever 60, so that the open lever 60 is biased in a direction away from the lower end 18*a* of the locking plate 18.

The open lever 60 is formed at its middle part with an input portion 63. When the striker base plate 40 is returned from the drawing stop position to the drawing start position, the input portion 63 functions to pivot the open lever 60 to the position to engage with the lower end 18*a* of the locking plate 18. That is, under this condition, the cam follower 56 of the output disc 55 pushes the input portion 63 of the open lever 60. As is seen from FIG. 18, the input portion 63 extends toward an end of the arcuate cam slot 41, so that when the cam follower 56 comes to the end of the slot 41, the input portion 63 is pressed by the cam follower 56.

Furthermore, the open lever 60 is formed at the output portion 61 with a smoothly curved pushing portion 65. Upon a given condition, the pushing portion 65 pushes up the lower end 18*a* of the locking plate 18 thereby to slightly lift the trunk lid 10 from the fully closed position. With this, a small clearance is created between the periphery 12 of the trunk opening 11 and the trunk lid 10, which is sized to receive operator's hands for facilitation of manipulation to fully open the trunk lid 10. That is, in operation, the pushing portion 65 is brought into engagement with the lower end 18*a* of the locking plate 18 to pivot the same to the unlocking position, and thereafter, the pushing portion 65 pushes up the lower end 18*a* of the locking plate 18. During this, the lower end 18*a* of the locking plate 18 is forced to slide on and along the smoothly curved pushing portion 65.

As is seen from FIG. 1, the center of the output disc 55 is formed with a rectangular opening with which one rectangular end of an input shaft 57 is engaged. The other end of the input shaft 57 is formed with a rectangular key 58 which is projected through the motor mounting plate 30 into a side where a power unit 70 is located The power unit 70 is mounted to a back surface of the motor mounting plate 30.

Figure 3:
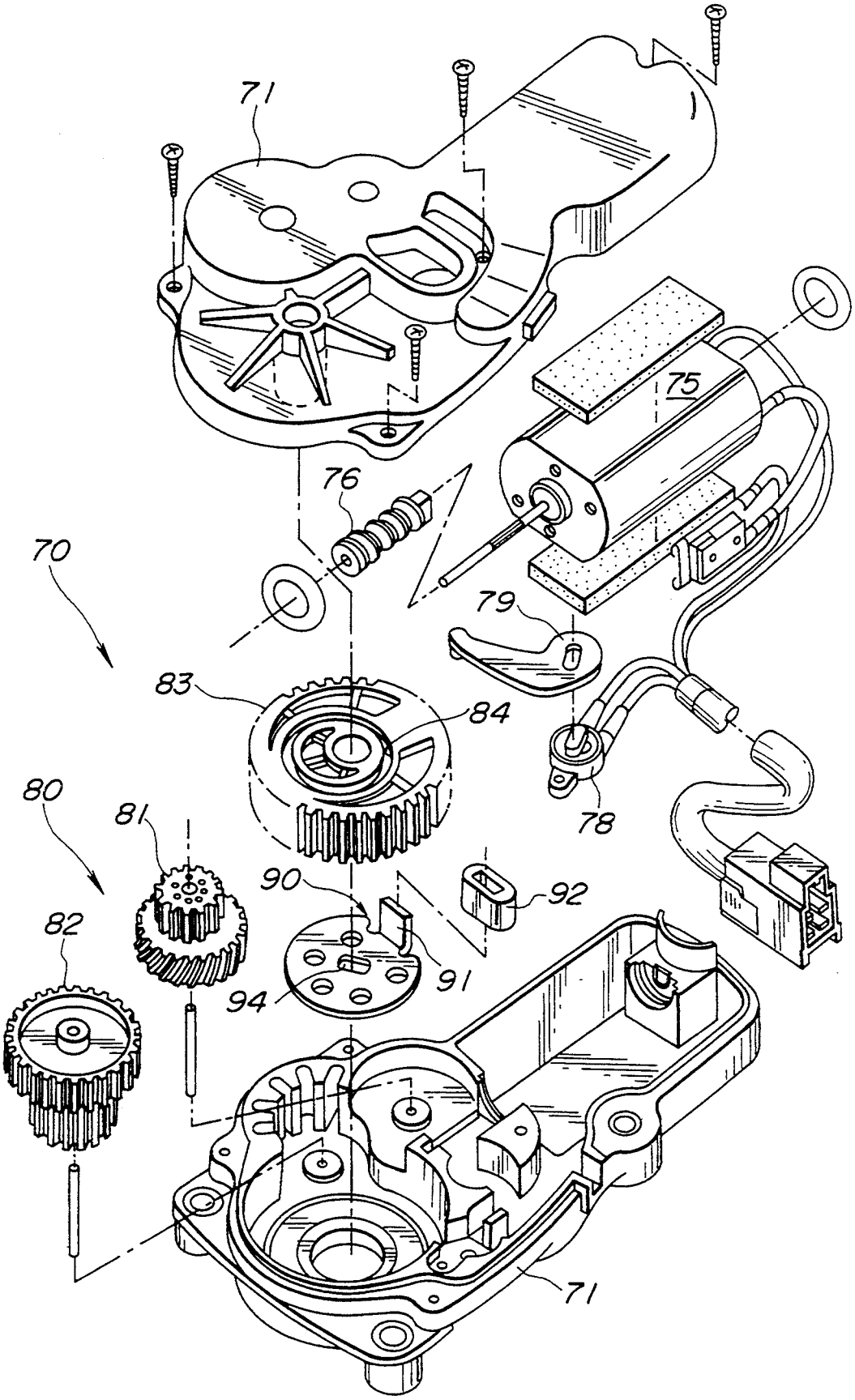
FIG. 3 is an exploded view of an electric drive unit employed in the power lid closing device of the present invention.
Figure 4:
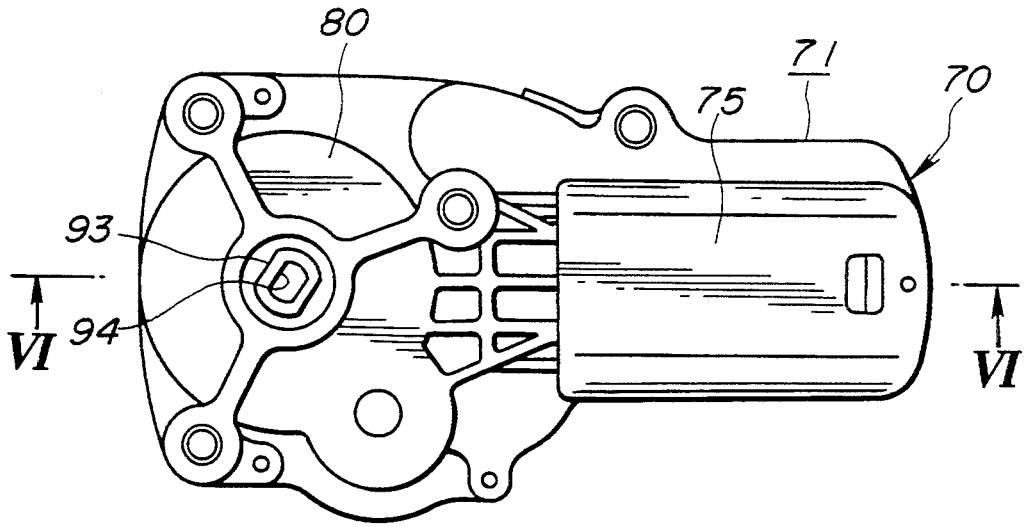
FIG. 4 is a back view of the electric drive unit which is assembled.
Figure 5:
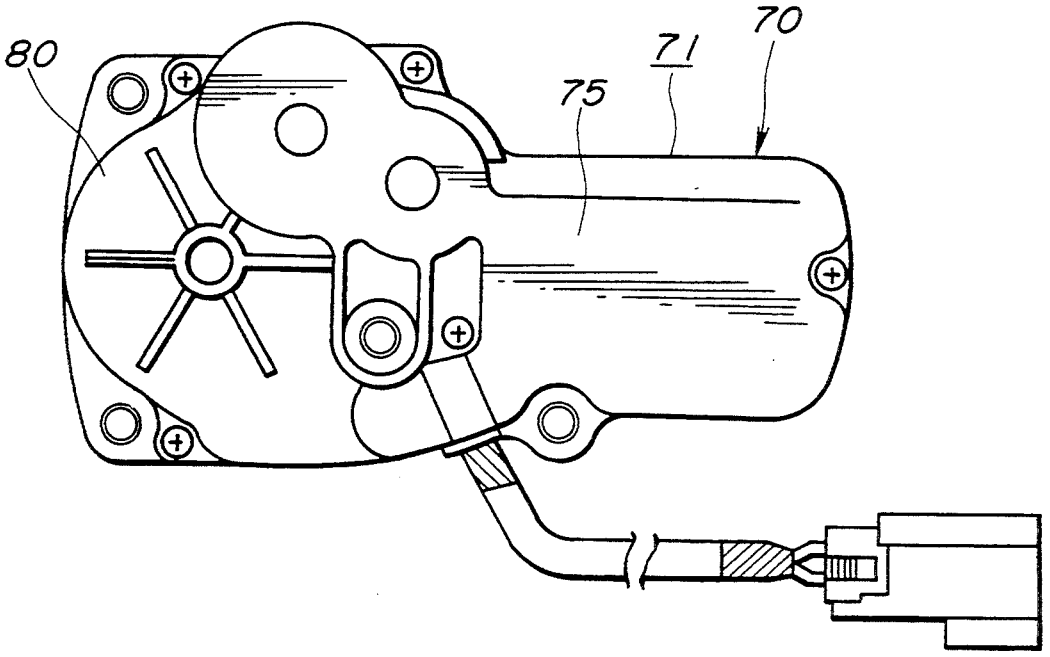
FIG. 5 is a front view of the assembled electric drive unit.
Figure 6:
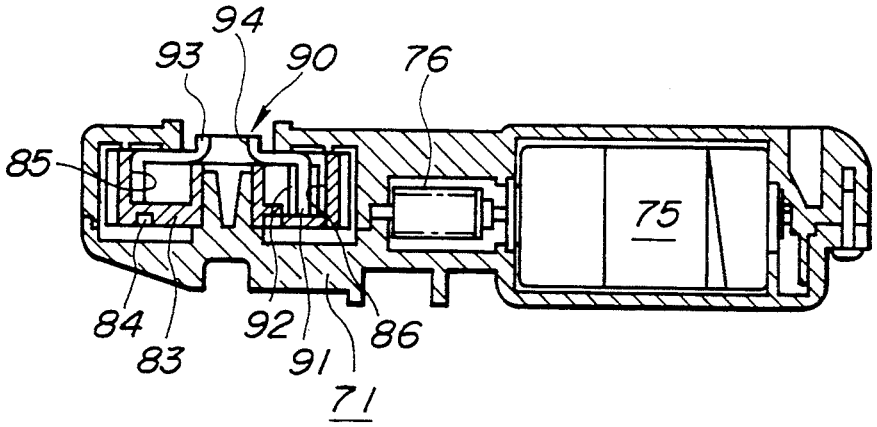
FIG. 6 is a sectional view taken along the line VI—VI of FIG. 4.
Figure 7:
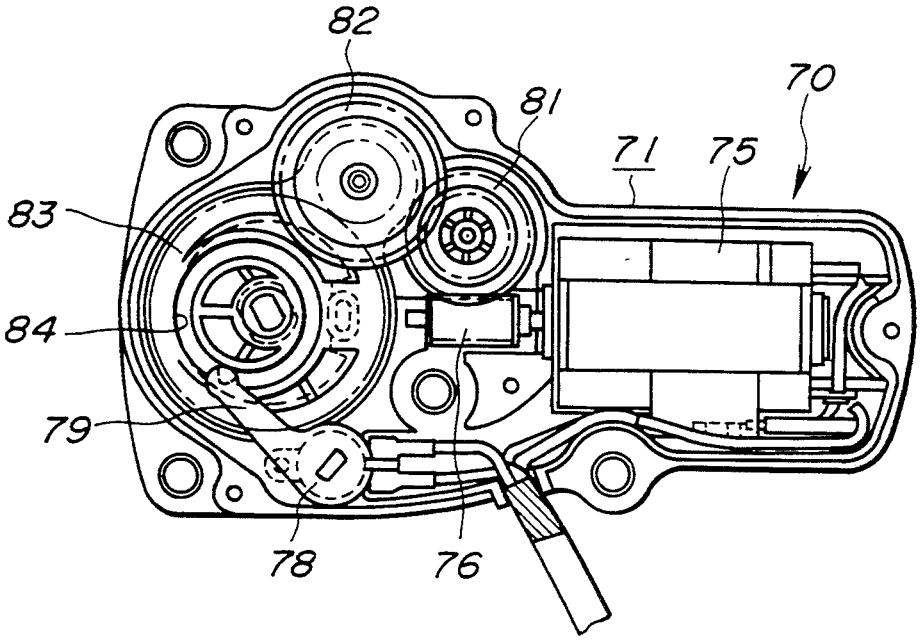
FIG. 7 is a front view of the assembled electric drive unit with a cover part removed for clarification of the drawing.
Figure 8:
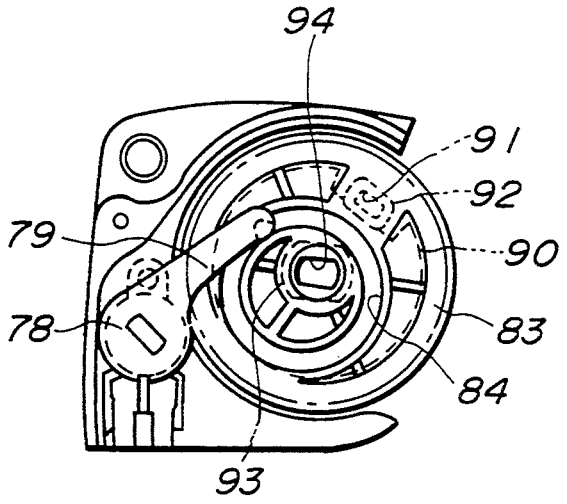
FIGS. 8 to 11 are front views of a rotary switch incorporated with the electric drive unit, but showing different operation conditions respectively.

As is seen from FIG. 3, the power unit 70 has a housing 71 which consists of two connectable halves. Within the housing 71, there are installed an electric motor 75 and a speed reduction gear 80. As shown, the electric motor 75 has an output shaft (no numeral) which extends axially in the housing 71. A worm 76 is fixed to the output shaft of the motor 75 to rotate therewith. The worm 76 is connected through two idle gears 81 and 82 to a spur gear 83.

As is seen from FIGS. 3 and 7 to 11, the spur gear 83 is formed at its back side with a circular cam groove 84 which is eccentric with respect to the rotation center of the spur gear 83. Within the housing 71, there is further installed a rotary switch 78 which has a pivotal switch lever 79 incorporated with the eccentric cam groove 84 of the spur gear 83. That is, the switch lever 79 has at its leading end a projection (no numeral) which is slidably engaged with the cam groove 84. Because of the eccentricity of the groove 84, rotation of the spur gear 83 induces ON-OFF operation of the rotary switch 78.

As is seen from FIG. 1, upon assembly of the power lid closing device of the invention, the spur gear 83 is so arranged that the axis thereof is perpendicular to the motor mounting plate of the lid drawing mechanism 20*a*.

As is seen from FIGS. 6 and 12 to 17, the spur gear 83 is formed at its front side with a circular recess 85 into which a transmission disc 90 is received. The diameter of the circular recess 85 is somewhat larger than that of the transmission disc 90, so that the disc 90 can play in the recess 85. The transmission disc 90 is formed at a peripheral portion with a bent arm 91. The bent arm 91 is equipped with a slider or damper member 92 for achieving a smoothed movement of the bent arm 91 relative to the radially extending groove 86. Upon assembly, the slider or damper member 92 is slidably received in a radially extending groove 86 formed in the front side of the spur gear 83. The radially extending groove 86 and the circular recess 85 are merged with each other. Of course, the radially extending groove 86 is deeper in depth than the circular recess 85. With such connection between the spur gear 83 and the transmission disc 90, the transmission disc 90 can move in a radial direction but slightly in the circular recess 85 of the spur gear 83. Furthermore, due to the dimensional difference between the circular recess 85 and the transmission disc 90, the latter can play slightly in the recess 85. That is, the power transmission from the spur gear 83 to the transmission disc 90 is smoothly made while permitting a radial play of the disc 90 in the circular recess 85.

Figure 12:
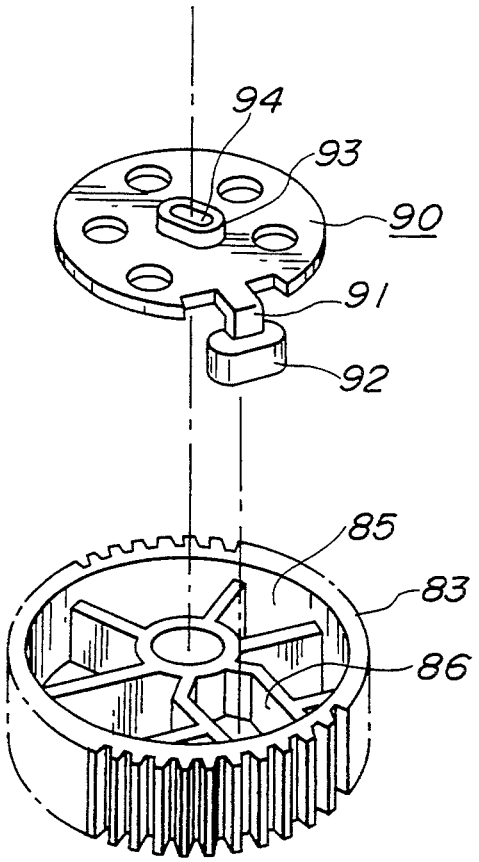
FIG. 12 is an exploded view of a transmission mechanism employed in the electric drive unit.
Figure 13:
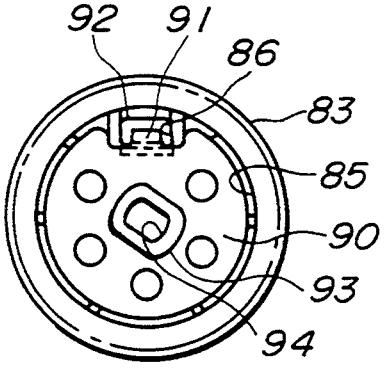
FIGS. 13 to 17 are front views of the transmission mechanism which is assembled, but showing different operation conditions respectively.
Figure 14:
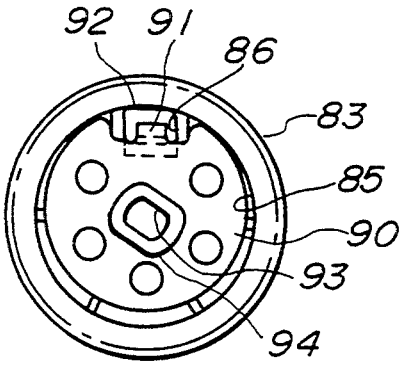
Figure 15:
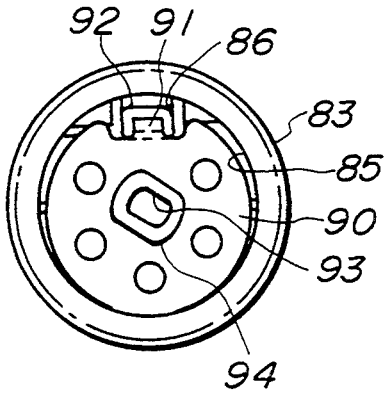
Figure 16:
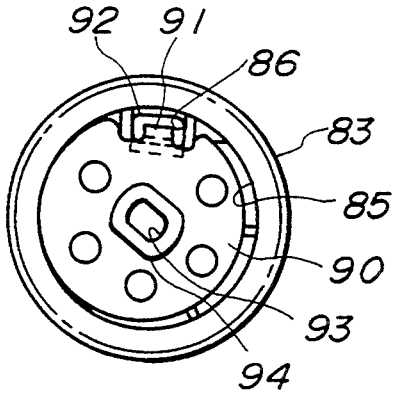
Figure 17:
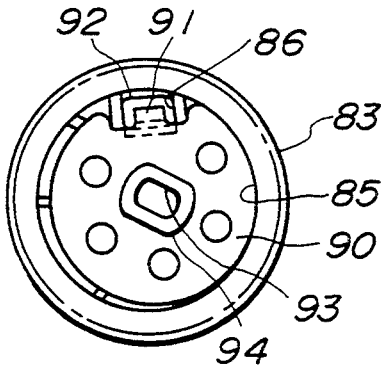

As is best shown in FIG. 12, the transmission disc 90 is formed at its center with a collared key opening 94. The collar is designated by numeral 93. As is seen from FIG. 1, the collared key opening 94 tightly receives therein the other end 58 (viz., rectangular key) of the input shaft 57. Thus, the output disc 55, the input shaft 57 and the transmission disc 90 rotate together.

In the following, operation of the power lid closing device will be described with reference to the drawings.

Figure 9:
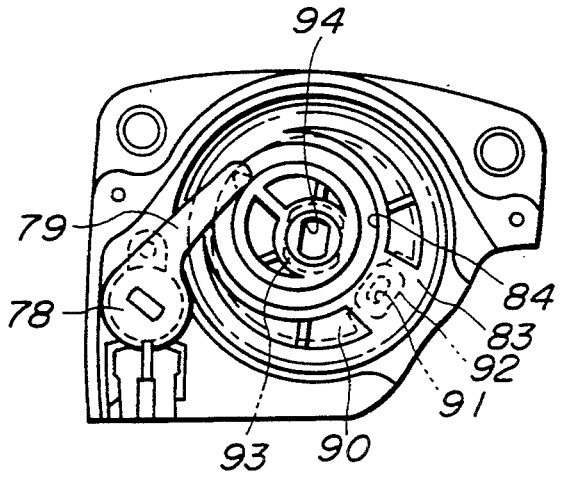
Figure 10:
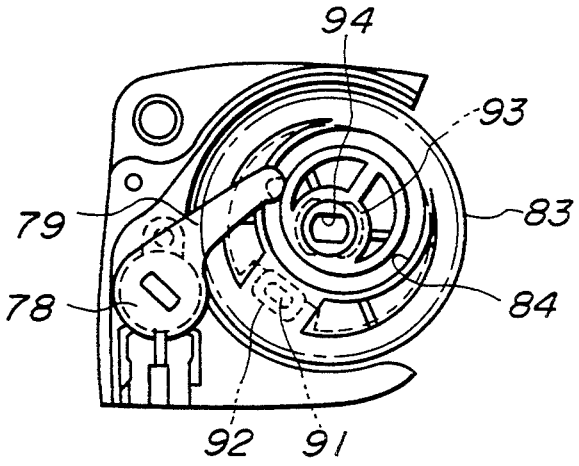

For ease of understanding, the description will be commenced with respect to a condition wherein the trunk lid 10 is fully opened as shown in FIG. 2. Under this condition, the lock mechanism 15 mounted on the trunk lid 10 assumes its open position, and the lid drawing mechanism 20*a* shows such a condition as shown in FIG. 21. That is, (see FIG. 18), in the lock mechanism 15, a projection 17*a* of the latch plate 17 engages with a recessed part 18*b* of the locking plate 18 thereby causing the locking plate 18 to press the switch knob 102 of the switch 100 (see FIG. 19), and in the lid drawing mechanism 20*a*, the striker base plate 40 is raised assuming the drawing start position, and the switch lever 79 of the rotary switch 78 assume such an angular position as shown in FIG. 9 causing OFF condition of the switch 78. Furthermore, as is shown in FIG. 21, the cam follower 56 of the output disc 55 takes a generally middle position of the arcuate cam slot 41.

When the trunk lid 10 is pivoted down to an almost closed position, the latch plate 17 of the lock mechanism 15 catches the striker 45 of the striker base plate 40 of the lid drawing mechanism 20*a* and thus assumes the latching position, and instantly the locking plate 18 becomes engaged with the latch plate 17 to lock the same at the latching position. Due to this movement, the locking plate 18 is separated from the switch knob 102 of the switch 100 inducing ON condition of the same. Upon this, the electric motor 75 of the power unit 70 is energized, so that as is seen from FIG. 7, the spur gear 83 is rotated in a given direction through the worm 76 and the idle gears 81 and 82, and thus the transmission disc 90 (see FIG. 3) is rotated in the same direction. Due to the rotation of the transmission disc 90, the output disc 55 is rotated to actuate the drive mechanism 50 of the lid drawing mechanism 20*a*.

Figure 22:
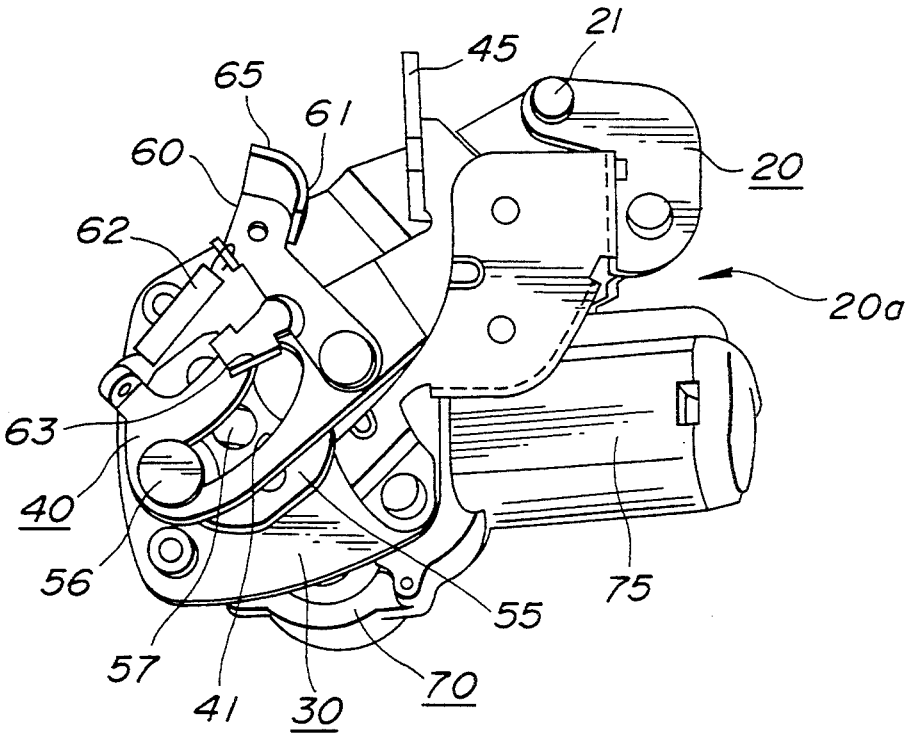

That is, in response to the counterclockwise rotation of the output disc 55, the cam follower 56 (see FIG. 21) carried by the output disc 55 is moved downward in the arcuate cam slot 41 from the middle position toward a left end of the slot 41 as is seen from FIG. 22.

Because of the arcuate shape of the cam slot 41, this movement of the cam follower 56 in the slot 41 induces a relatively large pivoting movement of the striker base plate 40 in a downward direction. Thus, at a first stage of the pivoting movement from the drawing start position, the trunk lid 10 is pivoted down at a relatively high speed. If the cam slot 41 is straight in shape, such high speed pivoting is not achieved.

It is to be noted that favorably such high speed pivoting of the trunk lid 10 to a certain angular position at the first stage brings about a relatively low pulling force generated by the drive mechanism 50. This phenomenon will be easily understood from the graph of FIG. 27 which shows the relationship between the distance (D) from the lid drawing start position and the pulling (or pushing) force (F) generated by the drive mechanism 50. Shown by a solid line curve is the relationship obtained by the arcuate cam slot 41, while, shown by a broken line curve is that obtained by a straight cam slot. As is seen from the graph, the pulling force generated by the drive mechanism 50 at the first stage of the pivoting movement of the trunk lid 10 is very small as compared with that of the straight cam slot. Accordingly, in the present invention, even if operator's hands are accidentally caught between the trunk lid 10 and the periphery of the trunk space 11, he or she can easily pull out the hands.

Figure 11:
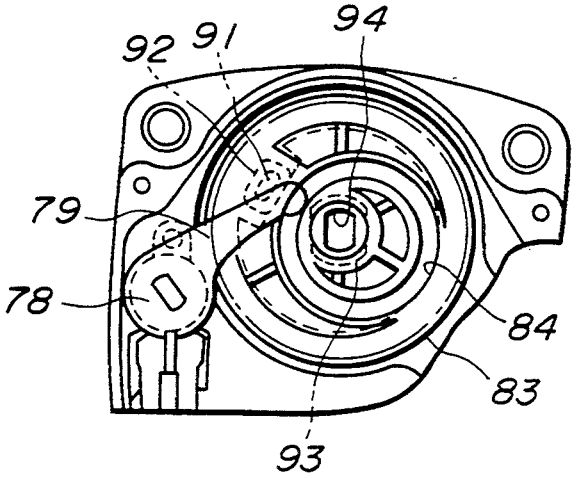

When, due to the continuous rotation of the output disc 55, the cam follower 56 is moved upward from the left end of the cam slot 41 of FIG. 22 to the middle position as shown in FIG. 23, the striker base plate 40 is pivoted down to the drawing stop position pulling down the trunk lid 10 against the counterforce produced by the weather strip on the periphery of the trunk space 11. During this movement, the switch lever 79 (see FIG. 10) of the rotary switch 78 is forced to slide in the eccentric cam groove 84 of the spur gear 83. (More specifically, the spur gear 83 is rotated keeping the slidable engagement with the switch lever 79). When the trunk lid 10 is fully closed causing the switch lever 79 to take such an angular position as shown in FIG. 11, the rotary switch 78 is turned OFF and thus the electric motor 75 of the power unit 70 is deenergized.

Figure 27:
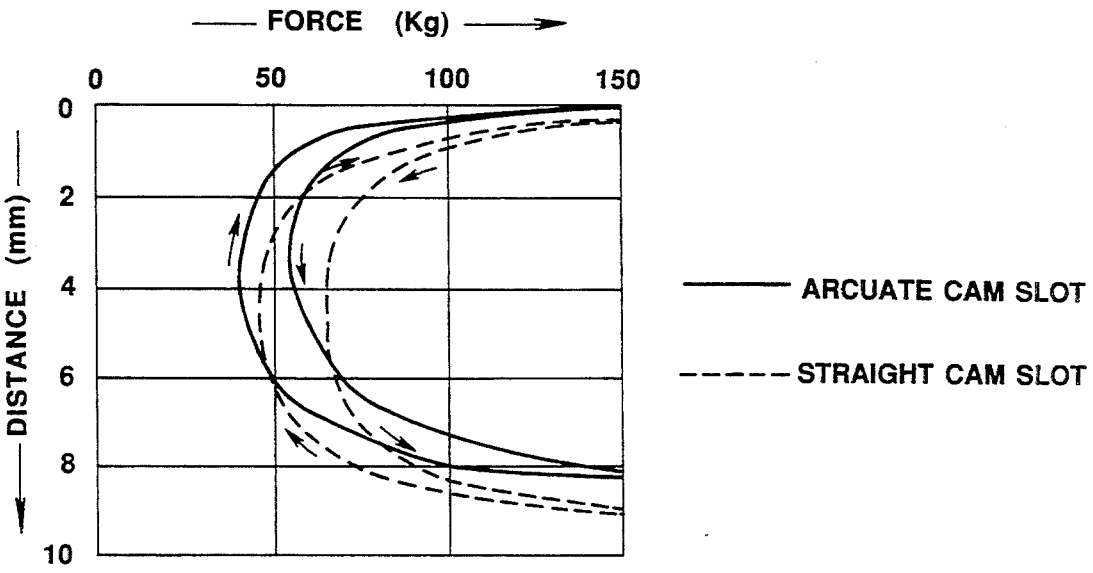
FIG. 27 is a graph showing a lid pulling force produced by the power lid closing device.
Figure 28:
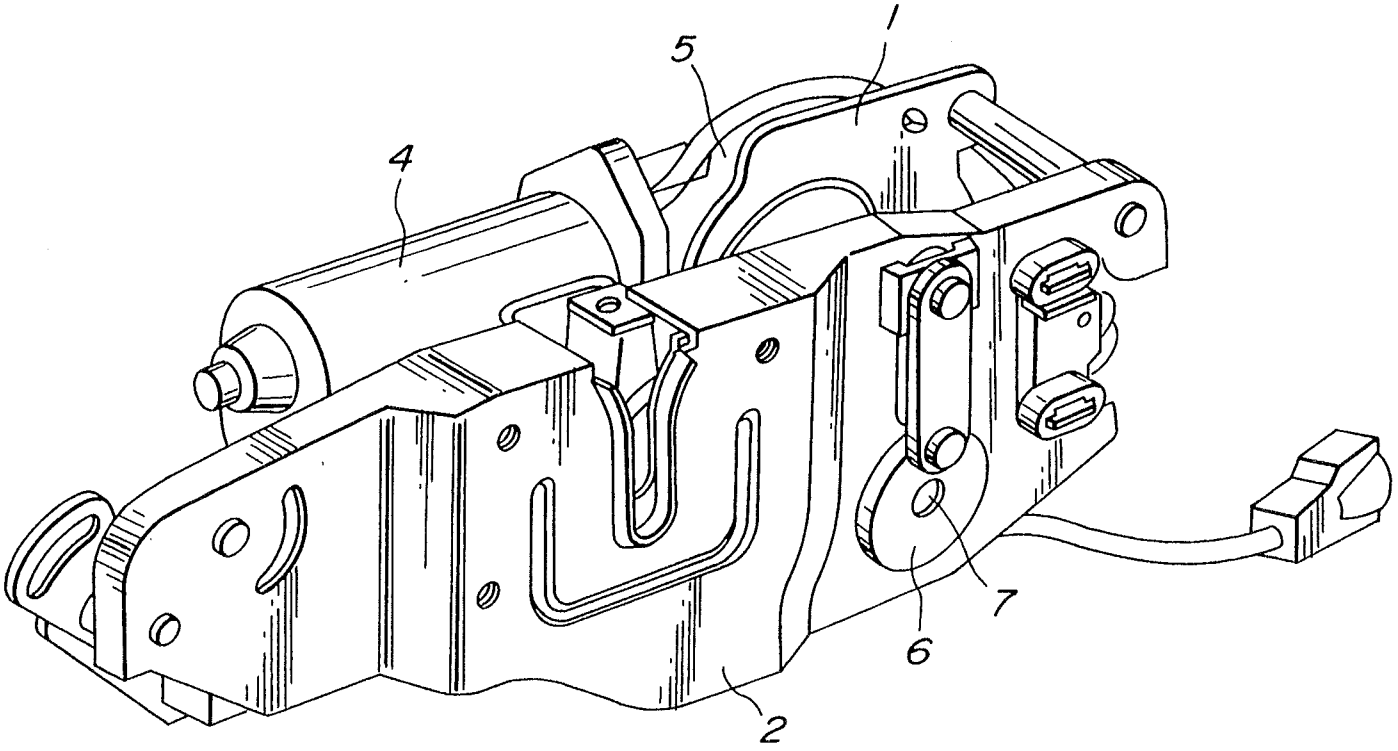
FIG.28 (PRIOR ART)
FIG. 28 is a perspective front view of a conventional power lid closing device.
Figure 29:
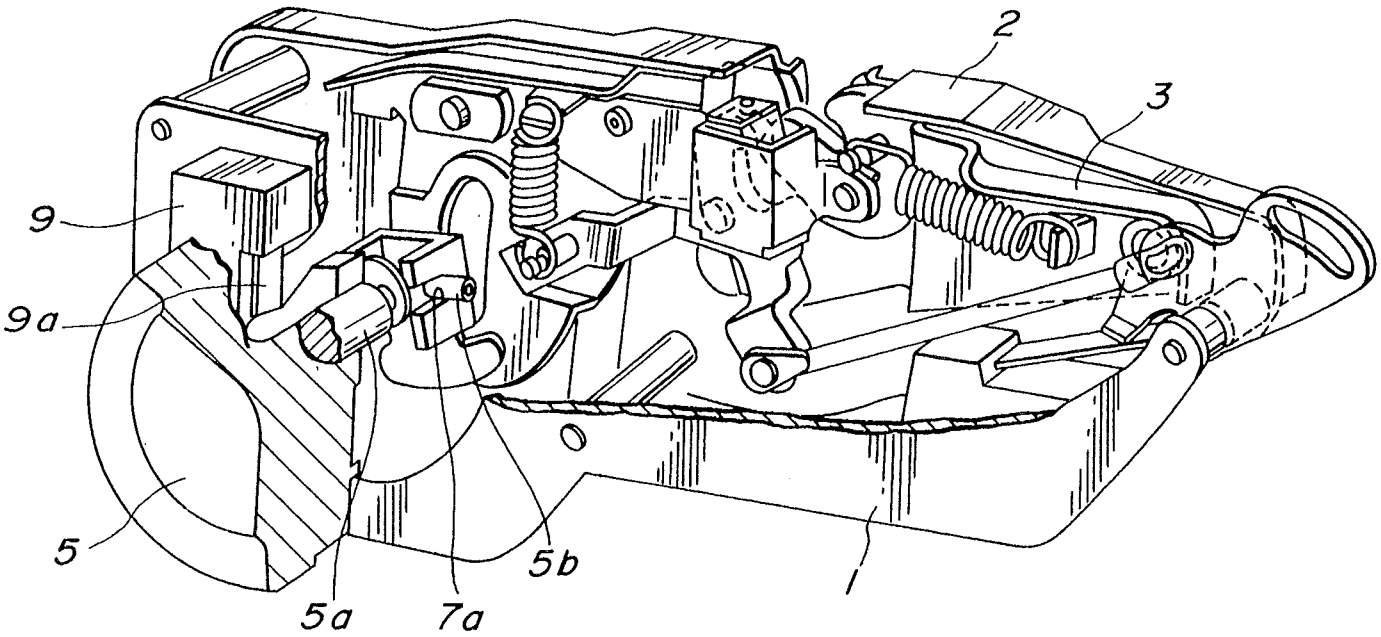
FIG.29 (PRIOR ART)
FIG. 29 is a partially broken perspective back view of the conventional power lid closing device.
Figure 30:
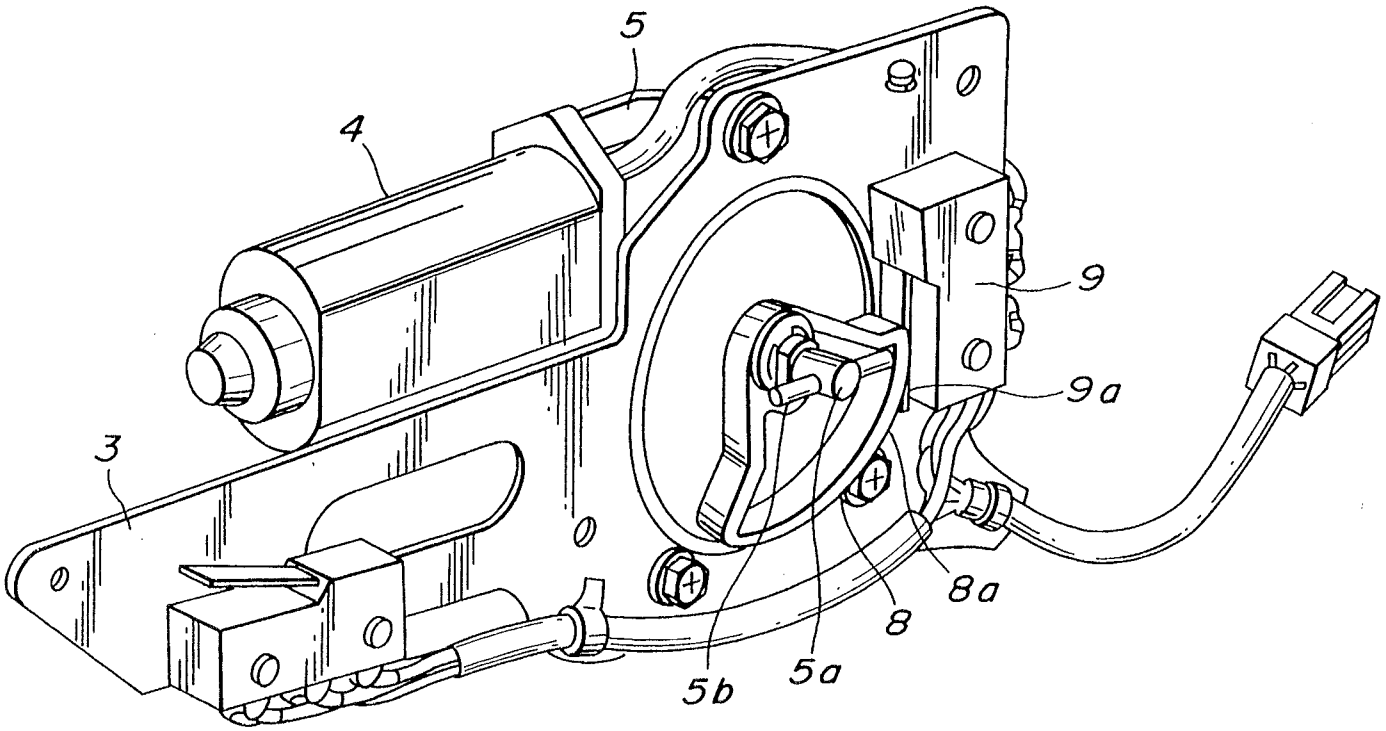
FIG.30 (PRIOR ART)
FIG. 30 is a perspective front view of the conventional power lid closing device, with some parts removed for clarification of the drawing.
Figure 31:
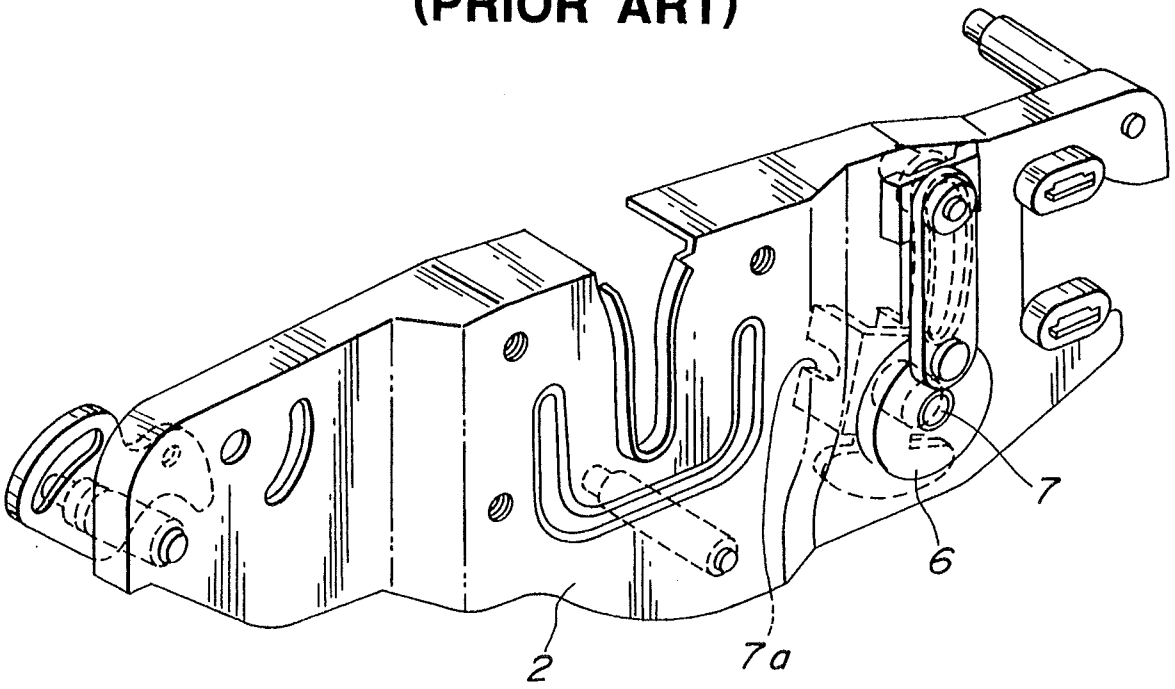
FIG.31 (PRIOR ART)
FIG. 31 is a perspective view of a cover base plate with some parts associated therewith, which is one part of the conventional power lid closing device.

As will be seen from the graph of FIG. 27, when the trunk lid 10 is in the process of being pressed against the weather strip of the trunk space 11, the pulling force generated by the drive mechanism 50 is large as compared with that of the straight cam slot. This means that the trunk lid 10 can be fully closed with assured sealing. When the trunk lid 10 is fully closed, the drawing mechanism 20*a* assumes the condition as shown in FIG. 23.

Figure 25:
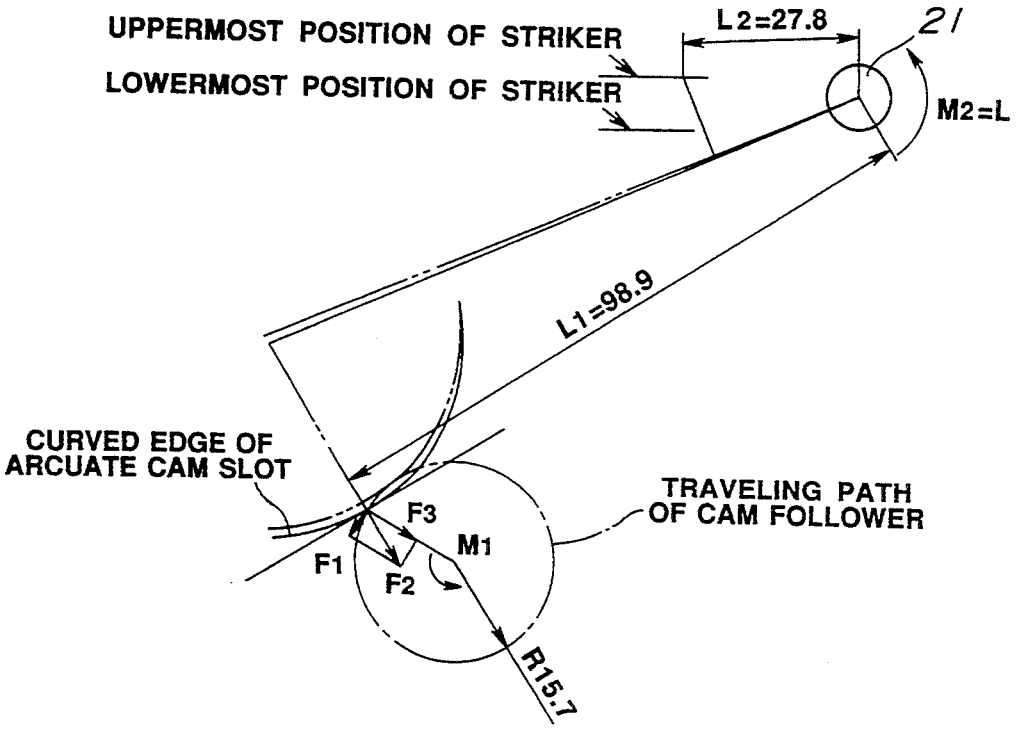
FIGS. 25 and 26 are schematic illustrations each showing the positional relationship between a cam groove and a cam follower.
Figure 26:
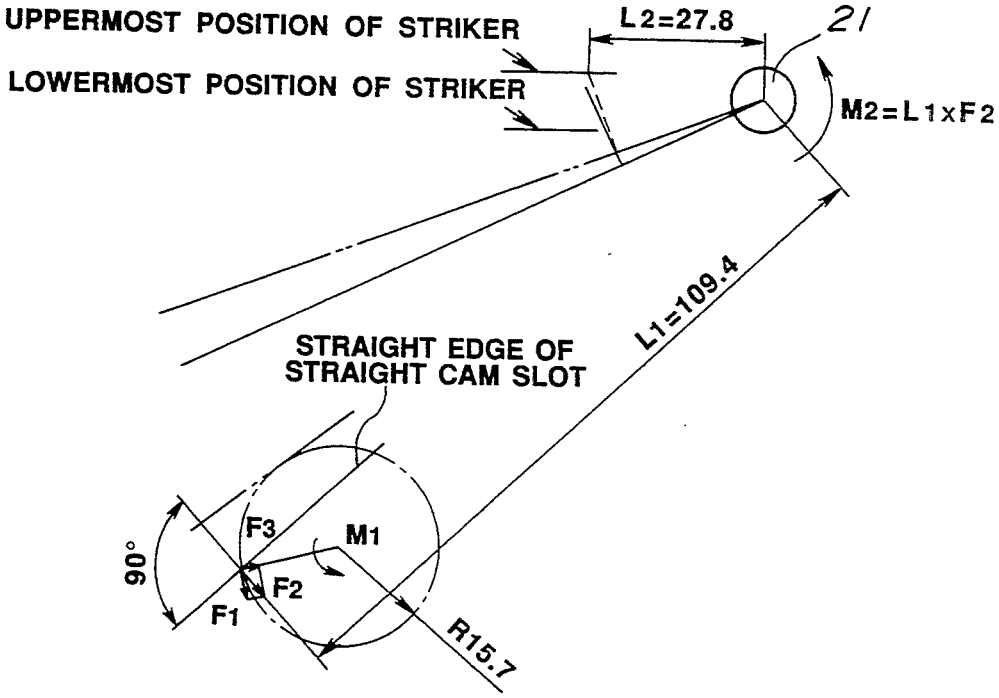

FIGS. 25 and 26 are schematic illustrations showing respectively the paths traveled by the cam follower 56 of the output disc 55 when the cam slot 41 is arcuate and straight. In these drawings, the vector "F2" corresponds to the force with which the trunk lid 10 is pulled.

As is seen from FIGS. 21 and 22, when the striker base plate 40 is being pivoted down from the drawing start position of FIG. 21 to the drawing stop position of FIG. 23, the open lever 60 is kept free, that is, kept apart from the lower end 18*a* (see FIG. 18) of the locking plate 18 and the cam follower 56 is kept separated from the input portion 63 of the open lever 60.

In order to open the trunk lid 10, the following operation is carried out.

As has been described hereinabove, when the trunk lid 10 is fully closed, the drawing mechanism 20*a* assumes the condition of FIG. 23.

Figure 24:
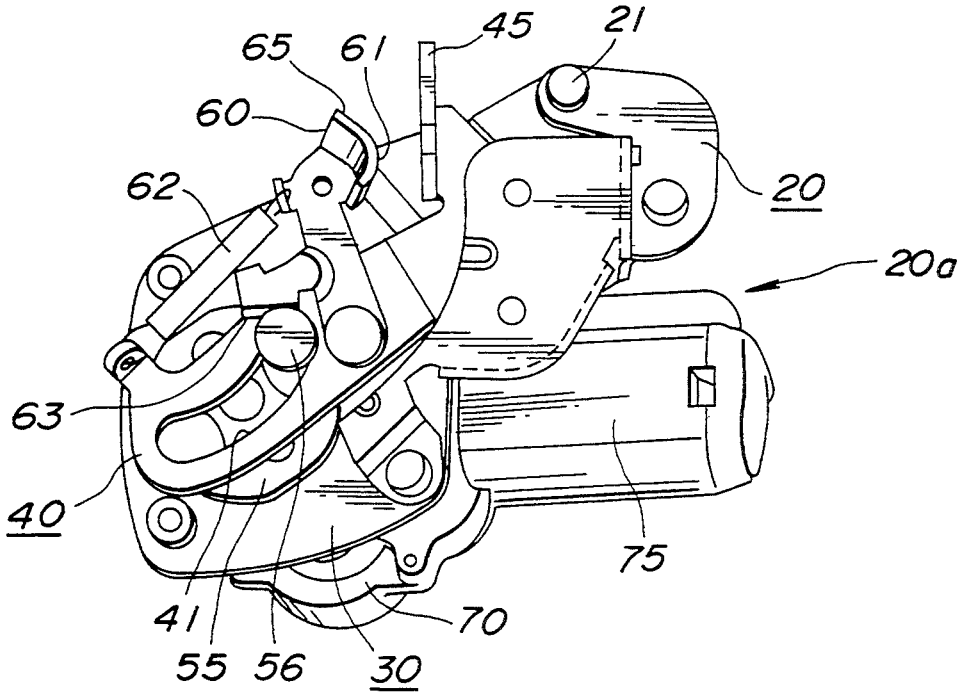

When an open switch (not shown) mounted in a passenger room of the vehicle is turned ON, the electric motor 75 of the power unit 70 is energized. With this, the output disc 55 is turned in the same direction, that is, in the counterclockwise direction, and thus, the cam follower 56 is moved upward in the arcuate cam slot 41 to a right end of the slot 41 as shown in FIG. 24. During this, the cam follower 56 pushes the input portion 63 of the open lever 60 causing the open lever 60 (more specifically, the output portion 61) to push the lower end 18*a* of the locking plate 18 (see FIG. 18). Thus, the locking plate 18 is pivoted to the unlocking position to unlock the latch plate 17. Thus, the lock mechanism 15 on the trunk lid 10 releases the striker 45 of the lid drawing mechanism 20*a*.

When thereafter, due to further rotation of the output disc 55, the pushing portion 65 of the open lever 60 pushes up the lower end 18*a* of the locking plate 18, the trunk lid 10 is slightly lifted. That is, the trunk lid 10 is forced to pivot up to a slightly open position even when a certain external load is applied to the trunk lid 10 due to presence of snow thereon and/or freezing of the trunk lid 10 to the vehicle body. Thereafter, the trunk lid 10 can be opened manually to its full open position by the operator.

During this, the switch lever 79 (see FIG. 8) of the rotary switch 78 is forced to slide in the eccentric cam groove 84 of the spur gear 83. When the switch lever 79 assumes the position as shown in FIG. 9, the rotary switch 78 is turned OFF and the electric motor 75 of the power unit 70 becomes deenergized and the striker base plate 40 of the lid drawing mechanism 20*a* is returned to the drawing start position as shown in FIG. 21.

In the following, advantages of the present invention will be described.

First, because the power unit 70 is compact in size, the entire construction of the power lid closing device can be constructed compactly. That is, unlike the case of the conventional device of Japanese Patent First Provisional Publication 4-302683, there is no need of using a so-called "elongate joint mechanism" in the present invention, and thus, the thickness of the device can be reduced. The arrangement wherein the axis of the spur gear 83 is perpendicular to the motor mounting plate 30 is important in reducing the thickness of the entire construction of the power lid closing device. Furthermore, usage of the spur gear 83 with which both the switch lever 79 of the rotary switch 78 and the transmission disc 90 are incorporated participates in reducing the size of the power lid closing device of the invention.

Second, since the transmission disc 90 is neatly received in the circular recess 85 of the spur gear 83, the thickness of the overall thickness of the unit consisting of the spur gear 83 and the disc 90 is reduced, which also participates in reducing the size of the lid closing device.

Third, since the transmission disc 90 is radially movably received in the circular recess 85 of the spur gear 83, combining the power unit 70 with the lid drawing mechanism 20*a* is easily achieved without paying marked attention to positioning therebetween. That is, even if there is a dislocation between the power unit 70 and the lid drawing mechanism 20*a*, the power transmission from the power unit 70 to the drawing mechanism 20*a* is assuredly made by the radially movable transmission disc 90.

Fourth, because of the nature of the arcuate cam slot 41, the downward movement of the trunk lid 10 at the first stage by the lid drawing mechanism 20*a* is carried out with a smaller pulling force. Thus, even if operator's hand or hands are accidentally caught in the downwardly moving trunk lid 10, he or she can easily pull out the hands.

Fifth, because of the nature of the arcuate cam slot 41, the downward movement of the trunk lid 10 at the final stage by the lid drawing mechanism 20*a* is carried out with a larger pulling force. This induces an assured compression of the weather strip of the trunk space 11 by the trunk lid 10.

Sixth, since the open lever 60 functions to push up the locking plate 18 after canceling the locked condition of the latch plate 17, the trunk lid 10 is assuredly lifted to a slightly open position even when a certain external load is applied to the trunk lid 10 due to presence of snow thereon and/or freezing of the trunk lid to the vehicle body.

What is claimed is:

1. A power lid closing device for use in a structure wherein a lid member is pivotally connected to a fixed member, comprising:

a lock mechanism mounted on said lid member;

a lid drawing mechanism mounted on said fixed member, said lid drawing mechanism including a motor mounting plate which is stationary, a striker base plate which is pivotally connected to said motor mounting plate and an output disc which pivots said striker base plate when rotated, said striker base plate having a striker engageable with said lock mechanism;

a power unit mounted to said motor mounting plate, said power unit including an electric motor and a speed reduction gear which are installed in a housing secured to said motor mounting plate, said speed reduction gear including a spur gear the axis of which is substantially perpendicular to said motor mounting plate;

means defining an eccentric cam groove in one side of said spur gear; and a rotary switch having a pivotal switch lever, said switch lever having a projection slidably engaged with said eccentric cam groove, said rotary switch being electrically connected to said electric motor.

2. A power lid closing device as claimed in claim 1, further comprising:

rotation transmitting means for transmitting rotation of said spur gear to said output disc irrespective of a certain axial displacement therebetween.

3. A power lid closing device as claimed in claim 2, in which said rotation transmitting means comprises:

means defining a circular recess in another side of said spur gear;

means defining a radially extending groove in said another side of said spur gear;

a transmission disc radially movably received in said circular recess, said transmission disc having at its periphery a bent arm slidably engaged with said radially extending groove; and a shaft member connecting respective centers of said transmission disc and said output disc.

4. A power lid closing device as claimed in claim 3, in which said circular recess of said spur gear and said radially extending groove of said spur gear are merged with each other.

5. A power lid closing device as claimed in claim 3, in which the depth of said radially extending groove is deeper than said circular recess.

6. A power lid closing device as claimed in claim 3, in which said bent arm of said transmission disc is equipped with a slider member for achieving a smoothed movement of said bent arm relative to said radially extending groove.

7. A power lid closing device as claimed in claim 3, in which said shaft member passes through an opening formed in said motor mounting plate, and said shaft member has two rectangular ends unmovably received in respective rectangular openings formed in said centers of said transmission disc and said output disc.

8. A power lid closing device as claimed in claim 7, in which the rectangular opening of said transmission disc is collared.

9. A power lid closing device as claimed in claim 1, in which said speed reduction gear further comprises:

a worm mounted on an output shaft of said electric motor; and two mutually engaged idle gears which are meshed with said worm and said spur gear respectively.

10. A power lid closing device as claimed in claim 1, in which said lid drawing mechanism further comprises:

means defining an arcuate cam slot in said striker base plate; and a cam follower carried by said output disc, said cam follower being slidably engaged with said arcuate cam slot so that rotation of said output disc induces a traveling of said cam follower in said arcuate cam slot causing pivotal movement of said striker base plate.

11. A power lid closing device as claimed in claim 10, in which said arcuate cam slot, due to rotation of said output disc, pivots said striker base plate down from a generally middle position to a lowermost position, wherein a pulling force generated by said striker base plate is gradually increased.

12. A power lid closing device as claimed in claim 11, in which said arcuate cam slot is so shaped that the longitudinal ends thereof are directed upward with respect to said fixed member to which said lid member is pivotally connected.

13. A power lid closing device as claimed in claim 10, in which said lid drawing mechanism further comprises an open lever which is pivotally connected to said striker base plate, said open lever canceling a locked condition of said lock mechanism when moved by said cam follower.

14. A power lid closing device as claimed in claim 13, in which said open lever comprises:

a major portion pivotally connected to said striker base plate;

an input portion against which said cam follower abuts when said cam follower comes to one extreme end of said arcuate cam slot; and an output portion which abuts against a lock member of said lock mechanism to cancel the locked condition of said lock mechanism when said major portion is pivoted in a predetermined direction by the abutment of said cam follower against said input portion.

15. A power lid closing device as claimed in claim 14, in which said output portion of said open lever is formed with a pushing portion, said pushing portion pushing up a lower end of said lock member of said lock mechanism to lift up said lid member from said fixed member when said major portion is pivoted in the predetermined direction by said cam follower.

16. A power lid closing device as claimed claim 15, in which said pushing portion is smoothly curved.

17. A power lid closing device as claimed in claim 13, in which said lock mechanism on said lid member comprises:

a lock base plate fixed to said lid member;

a latch plate pivotally connected to said lock base plate, said latch plate being capable of latching said striker of said striker base plate when they abut against each other; and a locking plate which is said lock member, said locking plate being pivotally connected to said lid lock base plate, said locking plate being engageable with said latch plate to lock said latch plate at the latching condition.

18. A power lid closing device as claimed in claim 16, further comprising a spring by which said latch plate and said locking plate are biased in opposite directions.

* * * * *